US006128827A

United States Patent [19]

Hendrix

[11] Patent Number: 6,128,827

[45] Date of Patent: Oct. 10, 2000

[54] STEAM-HEATED ROLL AND PROCESS

[75] Inventor: Gottfried Hendrix, Wesel, Germany

[73] Assignee: Voith Sulzer Papiertechnik Patent GmbH, Heidenheim, Germany

[21] Appl. No.: 09/210,817

[22] Filed: Dec. 15, 1998

[30] Foreign Application Priority Data

Dec. 17, 1997 [DE] Germany ..... 197 56 152
Mar. 4, 1998 [DE] Germany ..... 198 09 080

[51] Int. Cl.[7] ..... F26B 11/02; D06F 58/00

[52] U.S. Cl. ..... 34/121; 34/124

[58] Field of Search ..... 34/443, 444, 448, 34/449, 117, 121, 124, 125; 162/290, 359.1; 165/47, 89, 90

[56] References Cited

U.S. PATENT DOCUMENTS

| | | | |
|---|---|---|---|
| 2,413,567 | 12/1946 | Hornbostel . | |
| 3,967,386 | 7/1976 | Asfura | 34/124 |
| 3,988,200 | 10/1976 | Smith, Jr. | 162/290 |
| 4,184,268 | 1/1980 | Christin et al. | 34/124 |
| 4,205,457 | 6/1980 | Sjostrand | 34/124 |
| 4,501,075 | 2/1985 | Jenker et al. | 34/124 X |
| 5,230,169 | 7/1993 | Jaatinen et al. . | |
| 5,533,569 | 7/1996 | Reibel et al. | 34/124 X |
| 5,537,756 | 7/1996 | Haessner et al. | 34/124 X |
| 5,829,158 | 11/1998 | Straub et al. | 34/121 |
| 5,864,963 | 2/1999 | Konulainen | 34/124 |
| 5,878,507 | 3/1999 | Scheil et al. | 34/124 X |

FOREIGN PATENT DOCUMENTS

| | | |
|---|---|---|
| 2187056 | 4/1997 | Canada . |
| 0499597 | 12/1996 | European Pat. Off. . |
| 768424 | 4/1997 | European Pat. Off. . |
| 2454742 | 5/1976 | Germany . |
| 2553447 | 6/1977 | Germany . |
| 4337944 | 5/1994 | Germany . |
| 4313379 | 10/1994 | Germany . |
| 19538236 | 4/1997 | Germany . |

OTHER PUBLICATIONS

Beitz et al., *Dubbel–Taschenbauch für den Maschinenbau*, 15, Springer–Verlag Berlin, Heidelberg, New York, Tokyo, ISBN 3–540–12418–7, pp. 512–513, and 891–893 (1983).

*Primary Examiner*—Stephen Gravini
*Attorney, Agent, or Firm*—Greenblum & Bernstein, P.L.C.

[57] ABSTRACT

Steam-heated roll apparatus and process. The steam-heated roll may include a roll, a heating chamber arrangement within the roll, a feeding connection arrangement coupled to the heating chamber arrangement that is adapted for charging the heating chamber arrangement with steam, and a pump arrangement for pumping steam condensate out of the roll. The process includes charging the heating chamber with steam through the feed connection arrangement, and pumping steam condensate from an inside of the roll.

33 Claims, 5 Drawing Sheets

STEAM-HEATED ROLL AND PROCESS

CROSS-REFERENCE TO RELATED APPLICATIONS

The present application claims priority under 35 U.S.C. §119 of German Patent Application No. 197 56 152.7, filed on Dec. 17, 1997, and German Patent Application No. 198 09 080.3, filed Mar. 4, 1998.

BACKGROUND OF THE INVENTION

1. Field of the Invention

The present invention concerns a steam-heated roll having a heating chamber arrangement that can be charged with steam through a feeding connection arrangement.

2. Discussion of Background Information

In the manufacture of paper and other material webs, glazing is often necessary. In this regard, the material web is fed through a roll arrangement having at least one nip or gap, in which increased pressure is exerted on the material web. Among other things, this type of treatment is utilized to improve the characteristics of the surface.

In many cases, it is necessary to apply not only increased pressure on the material web, but also increased temperature. To accomplish this, at least one of the two rolls forming the nip is heated. A broad type of heating is realized by using a roll supplied with steam that transfers its heat to the roll. In this process, the steam is fed into a heating chamber arrangement inside the roll. While excess steam is dissipated from the heating chamber arrangement, a portion of the steam condenses. Theoretically, this effect is positive because, through condensation, a maximum amount of heat is transferred to the roll. However, the condensate, e.g., water, if water steam is used, must be removed from the roll.

Steam flow is currently used for this purpose, i.e., the steam flowing through the roll is used as a "steam surge" that drives the water out of the roll. This steam surge requires a relatively high expenditure of energy and costly differential pressure control. Moreover, under working conditions with lower steam temperatures and/or pressures and high work speeds, this arrangement leads to problems with drainage of the roll because the losses in pressure within the roll are too high and the condensate must be conveyed to the center of the roll in opposition to centrifugal force. Generally, the inflow conduit and outlet pipes for the steam are guided outwardly through a centrally located connection.

SUMMARY OF THE INVENTION

The present invention provides improved drainage possibilities for the roll. A pump arrangement may be utilized to pump condensate out of a steam-heated roll of the type generally discussed above.

In accordance with the exemplary embodiments of the present invention, it is not necessary that the steam supply provide a steam surge for driving the condensate out of the roll. Rather, the pump arrangement performs this function. The pump arrangement can perform a pumping task with significantly less loss and significantly more effectively than the steam surge procedure, thus keeping energy losses lower. Moreover, the pump arrangement can work in the roll independently of the steam pressure so that effective drainage is possible even under low steam pressure and high work speeds. The pump arrangement may be especially suited to pump condensate that has been pushed radially outwardly by centrifugal force back inwardly for removal through a central conduit. Accordingly, the pump arrangement, in accordance with the present invention, should be fundamentally structured to pump condensate in a direction opposition to centrifugal force.

Preferably, the pump arrangement may be located in a stationary position relative to the roll, i.e., to turn along with the roll. This substantially avoids the need for seals between moving parts, i.e., the roll and the pump arrangement. These two components may be aligned with each other during operation so that rigid connecting conduits, i.e., to and from the pump, can be provided.

It may be especially preferred to locate the pump arrangement on a front of the roll. Therefore, the pump arrangement may be structured as a separate component or component group that is, e.g., flange-mounted on the roll pins of the roll and, accordingly, rotates with the roll. While it is preferred that the pump arrangement not be flange-mounted immediately onto the roll itself, the pump arrangement may be located on the axial exterior of the roll pin where it surrounds the shaft end. Therefore, the pump arrangement requires practically no additional structural room and, additionally, does not disturb the normal operation of the roll.

Preferably, the pump arrangement may include at least one pump having a driving element that may be controlled from outside. It is noted that, if the pump can be driven from outside, no driving mechanisms are necessary inside the roll. It is only necessary for driving devices on the outside to be able to act on the driving element, so as to keep the weight and the inertial momentum of the roll low.

Preferably, the driving element work may work in conjunction with a stationary driving arrangement when the roll rotates. While the driving of the pump arrangement may be achieved by relative movement between the rotating roll and the driving arrangement, which means that a slightly higher energy output may be necessary to operate the roll, this difference is negligible. Moreover, in exchange for the negligibly slightly higher energy output, the driving possibility for the pump arrangement has a relatively simple structure.

It may be more advantageous for the driving element to include a restoring device. It is noted that a larger amount of power may be required to drive this embodiment because the opposing force of the restoring device must also be overcome. However, this embodiment is advantageous in that the driving mechanism must only work in one direction, e.g., to push in or pull out the driving element.

It may be advantageous for the pump arrangement to include a reciprocating pump that can, with a relatively small expenditure of energy, produce the necessary pressure to oppose the centrifugal force. A reciprocating pump can also be actuated relatively easily, in that the driving element may be moved radially inwardly and radially outwardly. Thus, a reciprocating pump may be completely sufficient for the desired area of application.

It may be preferable for the reciprocating pump to include a piston having an inlet steering edge and/or an outlet steering edge. Thus, not only can pump functions be realized with the piston, but a control function may also be realized such that, e.g., during a piston stroke, the inlet may be automatically closed so that the liquid that has escaped into the cylinder space can exit the cylinder space only through the outlet and cannot be pushed back through the inlet. The outlet steering edge can close the outlet during a return stroke by the piston so that the liquid that has been sent through cannot leak back in.

It may be especially preferable for the pump arrangement to include a revolving circumferential surface and for the driving arrangement to act on the pump arrangement from outside. In principle, the pump arrangement may include a ring construction that is attached to an outer reference circle with several pumps or pump segments. During rotation of the roll, the driving arrangement may be exposed to an essentially unchanged opposing surface, e.g., the radial outer wall of this ring construction. Thus, no special arrangements may be necessary to avoid protruding parts because the only parts that jut out or protrude are the driving elements of the pumps, which are moved radially inwardly and outwardly during rotation.

The driving arrangement may include a driving surface having a changing distance to the pump arrangement in the direction of the circumference. When the driving surface approaches the pump arrangement at a section of the circumference of the pump arrangement, the driving element may be pushed radially inwardly. When a greater distance is achieved at another section of the circumference, then the driving element may be pulled out again. Because the pump arrangement passes through all sections of the circumference in the course of a rotation of the roll, it may be ensured that at least one inward motion and one outward motion of the driving element of each pump occurs in the course of each single rotation. When the pumps in the pump arrangement are equally distributed circumferentially, one pump may always be "active," i.e., in operation. The other pumps may then be activated sequentially.

It may be especially preferable that the driving surface may be movable and may have essentially a same circumference speed as the pump arrangement. In this manner, relative motion between the driving surface and the pump arrangement in the rotational direction of the roll may be substantially prevented. Thus, the driving surface rotates along with the pump arrangement so that relative motion is limited to the in and out movement of the driving element. This structure helps to keep losses, and especially wear, low.

Preferably, the driving surface may include a circumferential surface of a wheel that is rotatable on its axis. Therefore, when a driving element of a pump comes into contact with the circumferential surface of the wheel, the wheel can be turned as well. The initial contact between the driving element and the wheel may be effected on a protruding driving element at the point where the distance between the wheel and the pump arrangement is still relatively large. With another rotation of the pump arrangement, the distance between a point where the driving element is situated on the wheel and the pump arrangement decreases for an amount of time until a shortest distance is achieved. The shortest distance may occur when a straight line passes through the midpoints of wheel and roll and the circumferential surface of the wheel. Then the distance begins to increase again and the driving element of the respective pump can be pushed back out. The wheel can be arranged in such a way that its circumference is a small distance from the pump arrangement. However, it is preferred that the circumferential surface of the wheel be in contact with the pump arrangement.

It may be especially advantageous, e.g., to utilize a propelled wheel that may be in contact with the roll through the pump arrangement, to provide a transfer of rotational momentum. The driving mechanism of the wheel may keep losses due to slippage low when its circumference speed is equal to the circumference speed of the pump arrangement, which may also minimize wear. In addition, when this wheel is connected to the roll in a manner to provide transfer of rotational momentum, then this wheel can also be used to drive the roll as a whole. The wheel can also be structured, e.g., as a frictional wheel. Moreover, the wheel can be connected, e.g., via teeth to corresponding teeth of the pump arrangement. The toothed wheel works can be arranged, e.g., in the axial longitudinal area, where the pumps may be either located or axially offset.

In an alternative embodiment, the driving surface can be formed by a driving belt that surrounds the pump arrangement on one part of its circumference and may be connected to a deflection roll placed outside of the pump arrangement. This may ensure that a movable driving surface is structured such that it has a small radial distance to the pump arrangement. The distance here is almost zero because the driving belt may be located directly next to the pump arrangement at a circumferential section. In the area where the deflection roll is situated, the distance increases again so that the driving elements of the pumps can be pulled out again.

Advantageously, the pump arrangement may include at least one rotary pump for pumping out condensate. Unlike reciprocating pumps, rotary pumps work with rotating and/or orbiting working elements. This may be advantageous because the mass distributions change very little during operation, which may lead to operation of a roll that is substantially uninfluenced by the operation of the pump arrangement. This may be particularly advantageous at a high RPM.

Preferably, the rotary pump may include at least one working element that can be activated from the outside. If the pump is capable of activation from the outside, no driving mechanisms are necessary within the roll, and it is only necessary to allow driving devices to act on the driving element from outside. In this manner, the weight and the inertial momentum of the roll may be kept low. Here, the pump arrangement can be placed in a stationary position relative to the roll, i.e., to rotate along with the roll. Accordingly, seals between moving parts, e.g., the roll and the pump arrangement, may be substantially avoided. The roll and the pump arrangement may be aligned with each other during operation so that rigid connecting conduits to and from the pump can be provided.

It may be advantageous for a pump inlet and a pump runoff to be constantly separated by the working element. In this manner, the working element ensures that no direct connection exists between the pump inlet and the pump runoff. Thus, no steam can escape, and any need for a ventilation control can be eliminated.

It may be advantageous for the working element to pass through at least one work sector during a rotation. In this manner, within the work sector, the working element may move a working chamber with constant volume from pump inlet to pump runoff. The liquid that reaches the pump inlet reaches the working chamber as well. In the working chamber that is movable through the working element, the liquid may be transferred from pump inlet to pump runoff. Because the volume of the working chamber may be constant, there may be no compression so that non-compressible liquids can be transported as well. Because liquid is constantly being transferred, the liquid in the pump runoff may be further displaced and pushed radially inwardly.

Preferably, the rotary pump may be structured as a blade unit pump. A blade unit pump may include a working element that is eccentrically placed on a housing having radial blades that can be pulled in and out. Therefore, the working element may be structured as a blade unit wheel. When the blade unit wheel turns, the corresponding working chambers appear in the area where the blade unit wheel is the greatest distance to the housing. Alternatively, the rotary pump can be structured as a centrifugal pump that works with a quickly rotating running wheel. Because the pump inlet may be connected to the steam supply by a channel that is inclined outwardly relative to the rotational axis of the roll, the condensate that forms may be sent to the pump entrance by centrifugal force, i.e., which occurs with a certain amount of admission pressure. The pumps, therefore, do not even need to create their own suction, but rather are filled with the condensate by the effect of this pressure.

Preferably, the driving element may work in conjunction with a stationary driving arrangement during rotation of the roll. The pump arrangement may be driven by the relative motion between the rotating roll and the driving arrangement. In this manner, a slightly higher output may be necessary to drive the roll, however, this slightly higher output may also be negligible. In exchange, the driving possibility for the pump arrangement may have a relatively simple structure.

Preferably, the driving element may be connected to a driving wheel in a manner that provides a transfer of rotational momentum, where the driving wheel is either in interlocking contact or frictionally engaging contact with an opposing wheel having an axis that coincides with the rotational axis of the roll. Thus, the driving wheel can either fit closely with the opposing wheel so that when the driving wheel is in motion it causes the opposing wheel to rotate via friction, or the two wheels can be toothed and interlocked. When the driving wheel is guided around the opposing wheel, which may generally be the case when the roll is rotating, then the driving wheel, in accordance with the relation between the edges of the driving wheel and the opposing wheel, may be rotated. Thus, a rotational movement in the driving element may be created.

It may be especially preferred that the opposing wheel may be attached to the bearing housing of the roll so that it cannot rotate independently. In this manner, rotation of the roll automatically drives the working elements of the pump arrangement. The higher the RPM of the roll, the higher the RPM of the working elements, and both the supply pressure and the supply amount increase accordingly. However, this is the desired effect, because the opposing pressure that must be overcome to supply the condensate may increase as the RPM increases.

In an alternative embodiment, the opposing wheel can be arranged relative to the bearing housing so that it is able to rotate, and may include a driving mechanism. In this manner, it may be possible to accelerate or decelerate the opposing wheel using an appropriate control of the driving mechanism to control the amount of condensate delivered by the pump arrangement.

In an alternative embodiment, the working element can have a steam drive. The flow of hot steam which, besides its thermal energy, creates a certain pressure, can drive the working element either directly or indirectly. The ensuing "steam losses" may be low and can be taken into account. For example, the steam flow can enter the pump chamber with the condensate to be transported or through additional bore holes and drive the blade unit wheel with the help of the blade units (or act on the blades).

Preferably, the working element may be connected to a turbine wheel in a manner to provide a transfer of rotational momentum, e.g., where the turbine wheel is accelerated by a flow of hot steam. In this manner, the flow path of the condensate and the flowing hot steam may be separated from each other more effectively.

Preferably, the heating chamber arrangement may include a large number of peripheral channels. This type of roll may be referred to as a "peripherally bored roll" even if the channels are constructed in some manner other than bore holes. The channels, which may be located relatively densely under the surface of the roll, feed the steam exactly to the point where its heat is to be transferred. At the same time, however, a channel structure is provided for the condensate so that it is simpler to collect and drain.

Even more preferably, the pump arrangement may be connected to the radial outer wall of the heating chamber arrangement by at least one condensate supply line. Therefore, the condensate supply line may be arranged at its start exactly at the point where the condensate will collect due to the centrifugal force generated by the working of the roll. In this manner, drainage may be facilitated.

Further, every channel may include a front feeding chamber and the condensate supply line may originate from the feeding chamber. The feeding chamber may serve to provide a connection between the steam inlet and the channel. The feeding chamber may be utilized to collect condensate and to pass it on to the condensate supply line.

Preferably, multiple channels may be assigned to one feeding chamber. Not only does this facilitate distribution of steam to single channels, but steam distribution can then occur relatively evenly in all channels. The number of pumps can also be decreased. Thus, it may no longer be necessary for a pump to be assigned to every channel, even though this is naturally possible. The single pumps can be evenly distributed in the circumferential direction and a feeding chamber can be provided for each pump.

However, a structure may be especially preferred in which the feeding chamber may be shaped as a ring chamber to connect all channels to each other. In this manner, a very even distribution of steam may be ensured. At the same time, an equally even removal of condensate may also ensured.

Preferably, the condensate supply line may be connected to the pump radially outwardly. The condensate may then be conveyed forwardly during operation, and may be pressed outwardly and to the pump by the centrifugal force. In this manner, the pump hardly needs to produce any suction.

Preferably, the pump may be connected by a back-run safety device vent to the discharge pipe, which is connected to a supply segment attached to the roll by a journal. When the pump has sent the condensate through the back-run safety device vent, e.g., a flap valve, the condensate cannot move outwardly under the influence of the centrifugal force. This makes the operation of the pump very dependable.

The present invention is directed to a steam-heated roll apparatus that includes a roll, a heating chamber arrangement within the roll, a feeding connection arrangement coupled to the heating chamber arrangement that is adapted for charging the heating chamber arrangement with steam, and a pump arrangement for pumping steam condensate out of the roll.

The present invention is also directed to a process for operating a steam-filled roll that includes a heating chamber arrangement, a feeding connection arrangement coupled to the heating chamber arrangement, and a pump arrangement. The process includes charging the heating chamber with steam through the feed connection arrangement, and pumping steam condensate from an inside of the roll.

In accordance with another feature of the present invention, the pump arrangement may include at least one pump, and the process may further include actuating the at least one pump externally from the roll.

In accordance with still another feature of the present invention, the pump arrangement may include a plurality of pumps, and the process may further include sequentially actuating the plurality of pumps to remove the steam condensate.

In accordance with yet another feature of the present invention, the process may further include rotating the roll so that the steam condensate in the roll may be moved radially outwardly, and moving the steam condensate radially inwardly toward a discharge tube.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
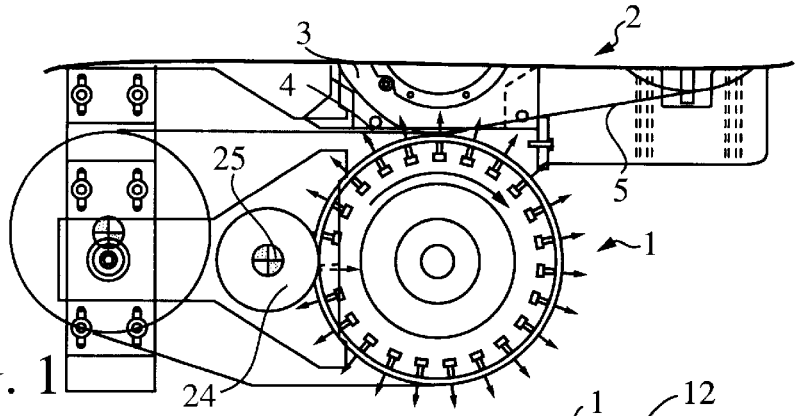
FIG. 1 illustrates a front view of a steam-heated roll in a roll arrangement in accordance with the features of the present invention.
Figure 2:
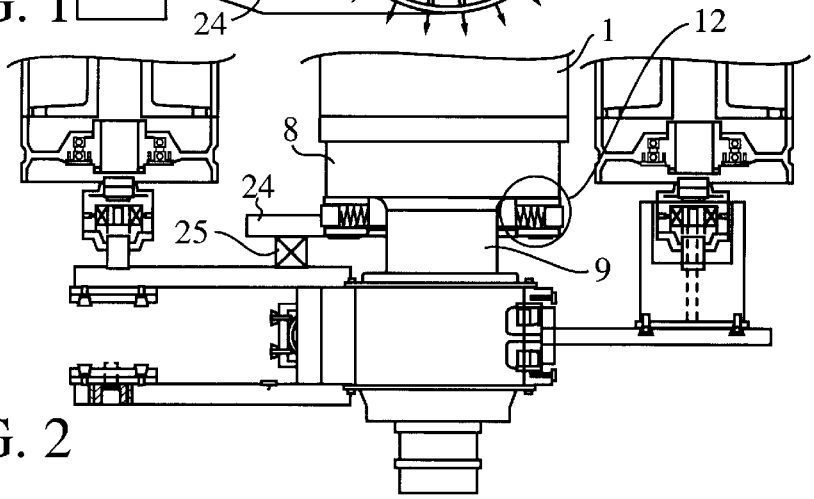
FIG. 2 illustrates a top view of one end of the roll depicted in FIG. 1.
Figure 5:
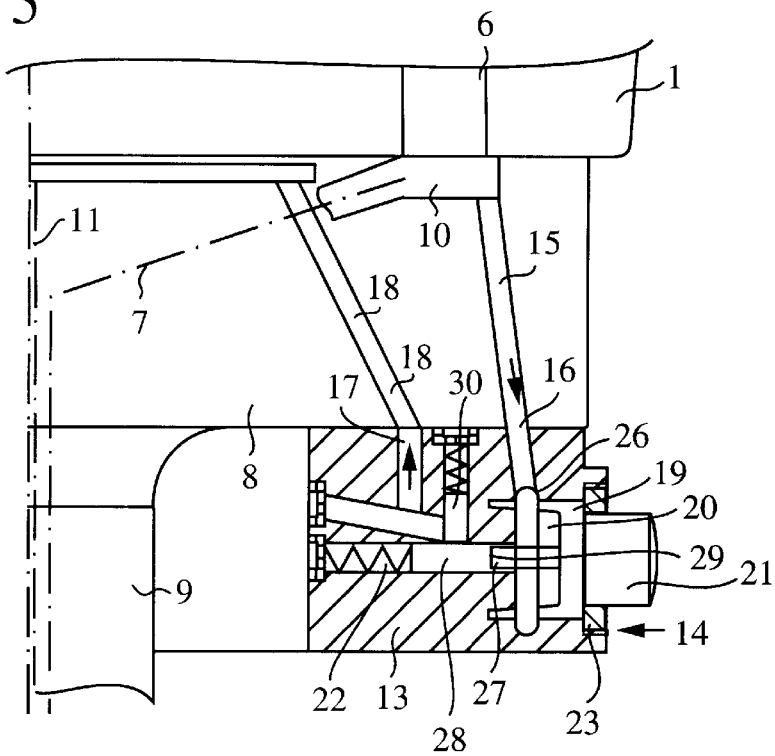
FIG. 5 illustrates a schematic diagram of a pump on a roll in accordance with the features of the present invention.

FIG. 1 illustrates a front view of heated roll 1, located in a roll arrangement 2, against an opposing roll 3 to form a nip or gap 4. A material web 5 may be guided through nip 4. Heating of heated roll 1 may be achieved, e.g., by feeding steam into peripherally arranged channels 6, as shown in FIG. 5. The steam may be fed through a steam supply conduit 7, which may be coupled to a shaft end 9 by a roll pin 8 that is flange-mounted onto a front of roll 1. Steam supply conduit 7 may be coupled to a steam distribution chamber 10, which may be structured as a ring chamber to couple all channels 6 of roll 1 to each other on their front ends. On the opposite face of roll 1, a similar arrangement can be provided to allow steam that has traveled through channels 6 to escape. As a rule, a run-off pipe 11 may pass through roll 1 to provide the steam escape and may pass through the same roll pin 8 and shaft end 9 as steam supply conduit 7.

The steam that flows through channels 6 may transfer its heat to roll 1 so as to heat the circumferential or peripheral surface of roll 1. In this regard, the greatest conduction of heat occurs when the steam condenses within roll 1. If water steam is used, the condensate forms water, which must be removed from the roll with the lowest possible expenditure of energy.

To this end, a pump arrangement 12 may be flange-mounted onto the front of roll pin 8, e.g., as illustrated in FIGS. 2 and 5–7.

Figure 6:
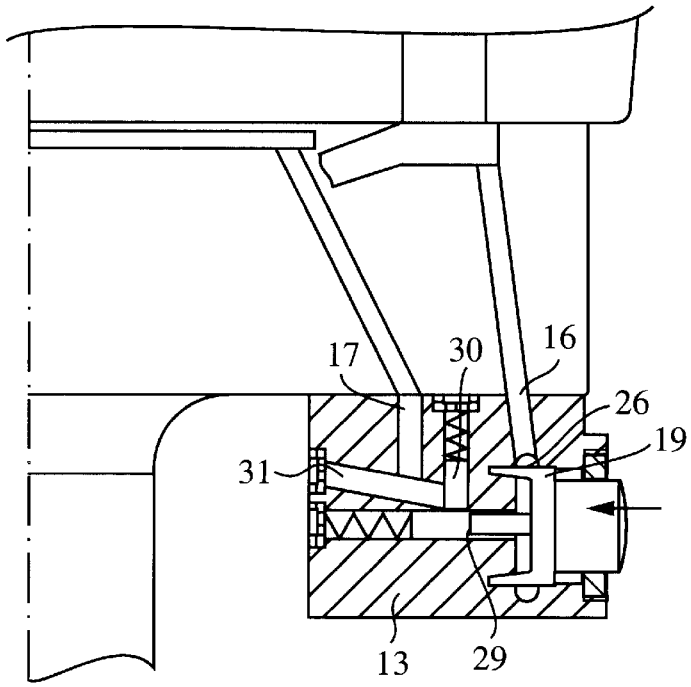
FIG. 6 illustrates the pump and roll depicted in FIG. 5 with the piston pushed in half way.
Figure 7:
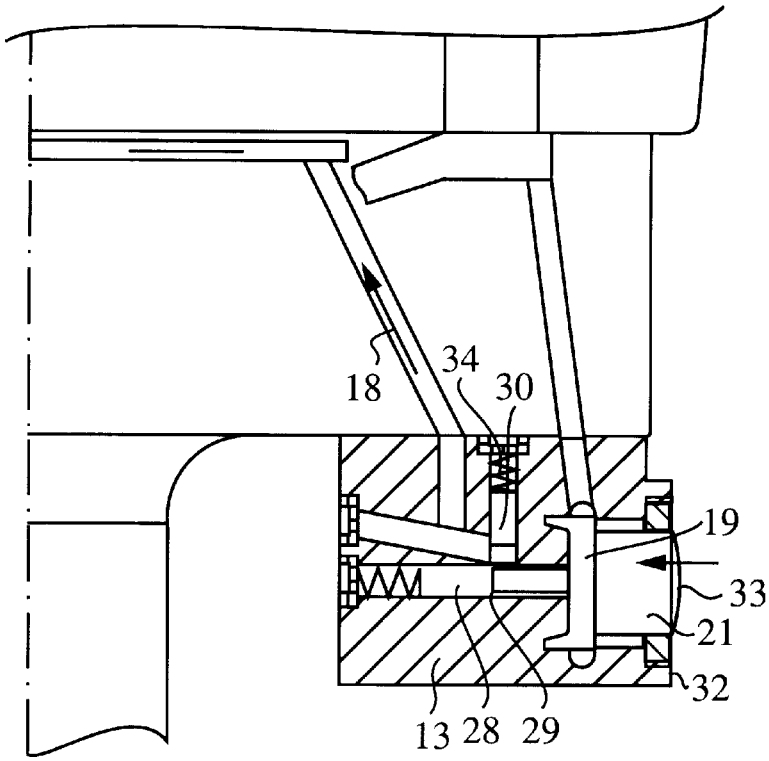
FIG. 7 illustrates the pump and roll depicted in FIG. 5 with the piston pushed in completely.

The pump arrangement 12 comprises a ring-shaped support 13 having an outer diameter approximately the same as the outer diameter of roll pin 8. As illustrated in FIG. 1, a plurality of individual pumps 14 may be arranged to be substantially evenly distribution across the circumference of support 13. As illustrated in FIGS. 5–7, each pump 14 may be coupled to steam distribution chamber 10 by a condensate supply conduit 15. Condensate supply conduit 15 may be arranged somewhat on an incline relative to, i.e., transversely to, a central axis of roll 1 so as to rise (extend axially and radially outwardly) from steam distribution chamber 10 toward pump 14. In this manner, during operation, condensate may be pushed by centrifugal force to an inlet 16 of pump 14. Pump 14 may also include an outlet 17 that may be coupled to run-off pipe 11 through a discharge pipe 18. In this manner, the condensate can flow out of roll 1 through run-off pipe 11 with the steam flow. Naturally, a separate pipe can also be utilized for the condensate.

Pump 14 may be composed of, e.g., a reciprocating pump that includes a piston 19 arranged for radial movement within a cylinder 20. Piston 19 may be coupled to a driving element 21, e.g., a ram, and to a restoring element 22, e.g., a spring. Piston 19 and driving element 21 may, e.g., be formed as one piece. Driving element 21 may radially jut out or protrude from support 13, and may be guided in a seal 23 to be sealed off. At the same time, seal 23 may form a stop that fits closely to piston 19 in its radially outermost position.

The operation of pump 14 occurs during rotation of roll 1. As shown in FIG. 1, a driven wheel 24 may be arranged in roll arrangement 2 so as to abut or rub against the circumferential surface of support 13. Thus, wheel 24 can drive roll 1 via its drive 25. However, it is not necessary that wheel 24 include a drive 25.

When roll 1 rotates, driving elements 21 of each pump 14 rotate to pass under wheel 24, i.e., driving elements 21 are guided through a nip formed between the circumferential surface of support 13 and the circumferential surface of wheel 24. The inward movement of driving elements 21 results in a corresponding inward movement of pistons 19. After driving elements 21 rotate beyond wheel 24, restoring element 22 may push piston 19 radially outwardly. Each pump 14, therefore, may go through one cycle per rotation of roll 1 to move the condensate liquid in cylinder 20, or at least a part of the condensate liquid, radially inwardly so that it can be drained through run-off pipe 11.

It is noted that more than one wheel 24 may be utilized in accordance with the features of the present invention. In this event, every pump 14 would complete a number of cycles, i.e., forwarding strokes, per rotation of the roll that corresponds with the number of wheels 24. However, one forwarding stroke per pump 14 and per rotation is sufficient to remove the condensate that arises from roll 14.

Instead of the frictional contact depicted in the exemplary figures, wheel 24 may be provided with a toothed arrangement on its circumference that contacts a corresponding toothed arrangement on the outer circumference of support 13. Again, driving elements 21 may be pushed inwardly once in every cycle.

Because wheel 24 has the same circumference speed as support 13, substantially no frictional losses occur between support 13 and wheel 24, and wear may be kept relatively low.

Piston 19 may include an inlet steering edge 26 that is somewhat axially arranged in the form of, e.g., a rotating apron on the edge of piston 19. When piston 19 is in its resting position, see FIG. 5, i.e., in the radially outermost position, inlet steering edge 26 may release inlet 16 completely so that cylinder 20 (i.e., the piston chamber) can be filled with the condensate liquid.

When piston 19 has been moved radially inwardly by about half of its stroke, see FIG. 6, inlet steering edge 26 may close inlet 16 so that the condensate liquid can no longer escape through inlet 16 as piston 19 continues to move inwardly.

Further, piston 19 may have a central extension 27, which has a thickening 28 on its end, against which restoring element 22, e.g., a spring, may be fitted. Restoring element 22 may be compressed when piston 19 moves inwardly. The transfer region between central extension 27 and thickening 28 may form an outlet steering edge 29, which may somewhat open a flow path to a flap valve 30 when inlet steering edge 26 closes inlet 16. As soon as outlet steering edge 29 opens the path to flap valve 30, which may also be configured with other known back run safety device vents, the liquid can push open flap valve 30 and move into outlet 17, and from there into discharge pipe 18. If necessary, an auxiliary channel 31 can be provided, which may couple the outlet of flap valve 30 with outlet 17.

When piston 19 moves further inwardly, see FIG. 7, to the point where piston 19 may come to rest at its radially innermost position, e.g., against support 13, the liquid located in cylinder 20 may be almost completely displaced. In this position, driving element 21 locks in a practically flush position with circumferential surface 32 of support 13. A small bump or tailoring 33 of the driving element 21 will not adversely effect the system as long as wheel 24 has a correspondingly elastic surface.

It is obvious that outlet steering edge 29 may only open flap valve 30 to an extent that the closing mechanism of the flap valve, when it has been returned to its resting position via readjusting spring 34, can then fit against thickening 28. Further safety measures are not necessary.

In the position of piston 19 as illustrated in FIG. 7, the pressure of the condensate liquid may be reduced through discharge pipe 18. As soon as the pressure in cylinder 20 is low enough, valve 30 may close again. In this regard, the closing element of valve 30 may be pushed in front of auxiliary channel 31 by the force of readjusting spring 34.

Figure 3:
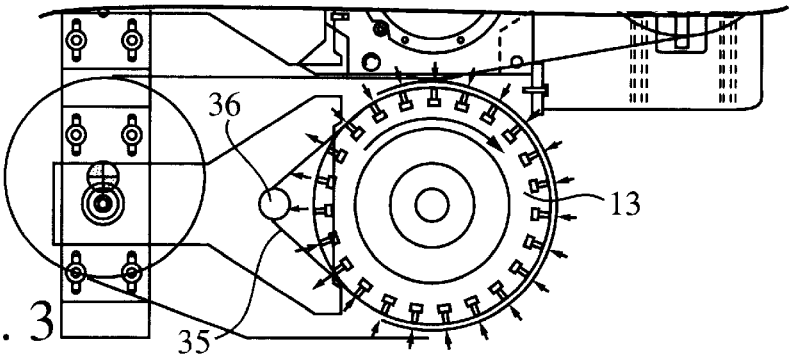
FIG. 3 illustrates an alternative embodiment of the roll depicted in FIG. 1.
Figure 4:
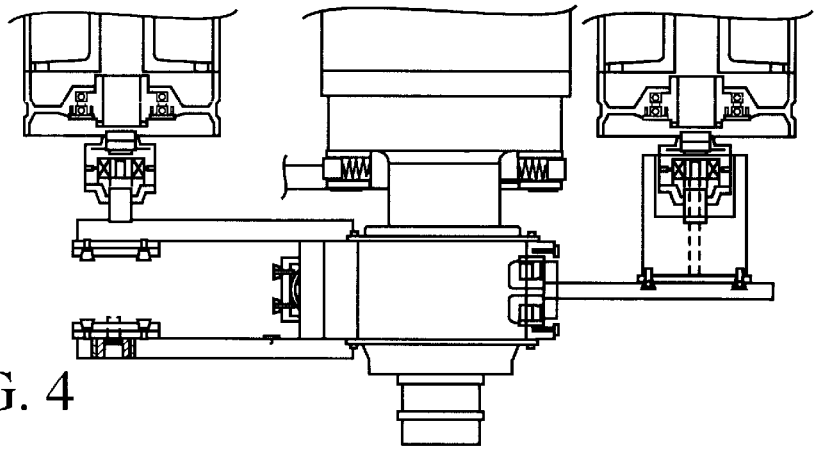
FIG. 4 illustrates a top view of the alternative embodiment depicted in FIG. 3.

FIGS. 3 and 4 illustrate an alternative embodiment of the drive for pumps 14. Instead of wheel 24, a driving belt 35 may be provided, which rests against a large portion of the circumference of support 13. Driving belt 35 may be guided over a deflection roll 36, which may be positioned a distance from circumferential surface 32 of support 13. In the area where driving belt 35 is lifted from support 13, driving elements 21 may be moved outwardly, as represented by the radially outwardly directed arrows. In the remaining area of the circumference, i.e., where driving belt 35 fits against support 13, driving elements 21 may remain pushed inwardly, as represented by the radially inwardly directed arrows. In this case, piston 19 may remain in the position shown in FIG. 7 for most of the rotational cycle, instead of the position shown in FIG. 5, as was the case with the exemplary embodiment of FIGS. 1 and 2. In both instances, practically the same pump capacity results. As explained above, the reduction in pressure that causes valve 30 to close can also occur when piston 19 is in the position shown in FIG. 7.

Figure 8:
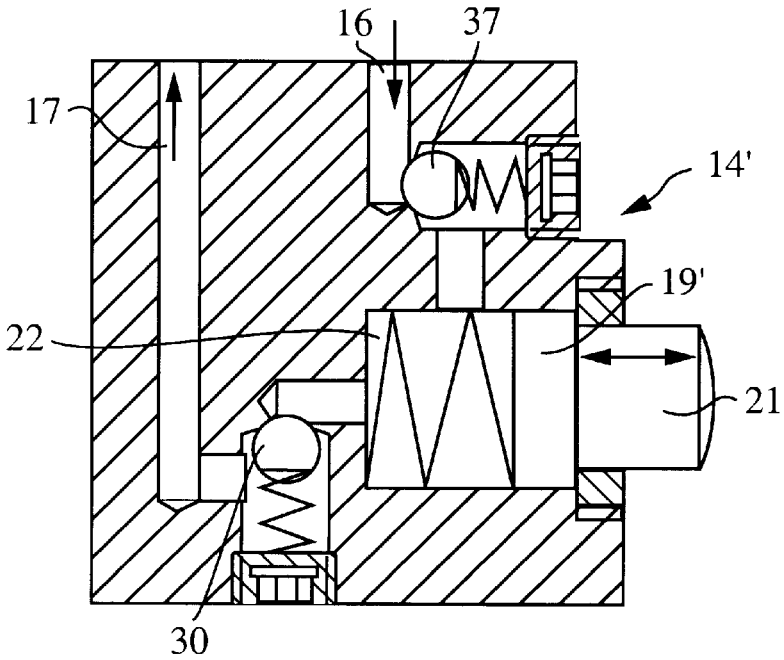
FIG. 8 illustrates an alternative embodiment of the pump.
Figure 9:
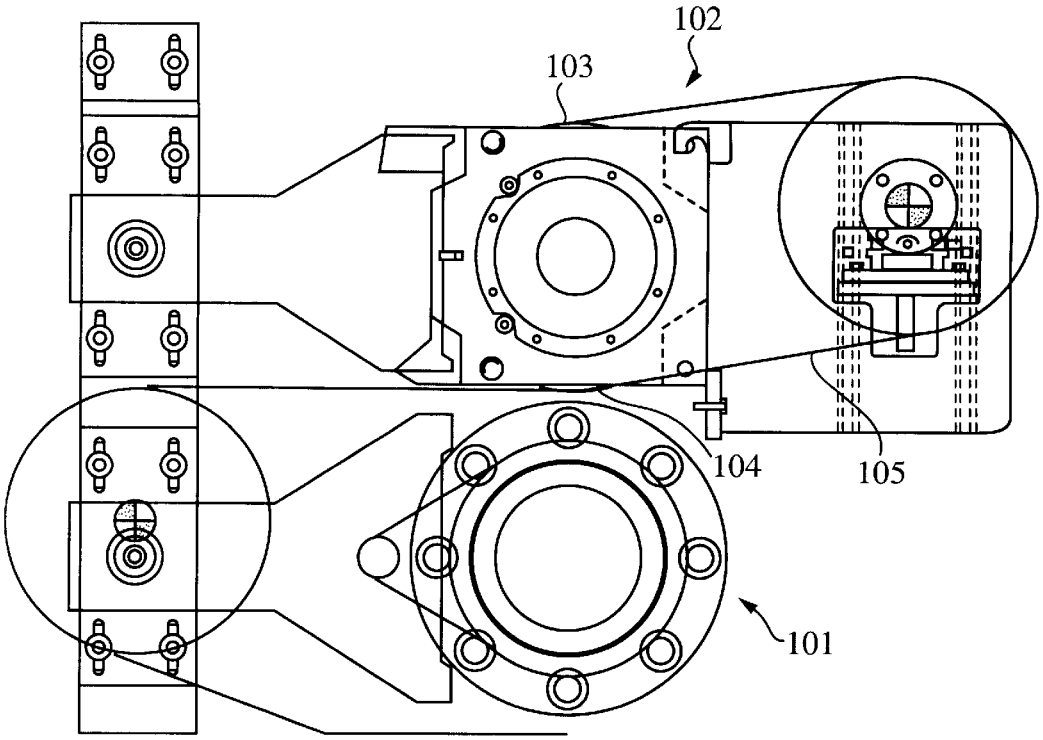
FIG. 9 illustrates a front view of a steam-heated roll in a further embodiment of a roll arrangement.
Figure 10:
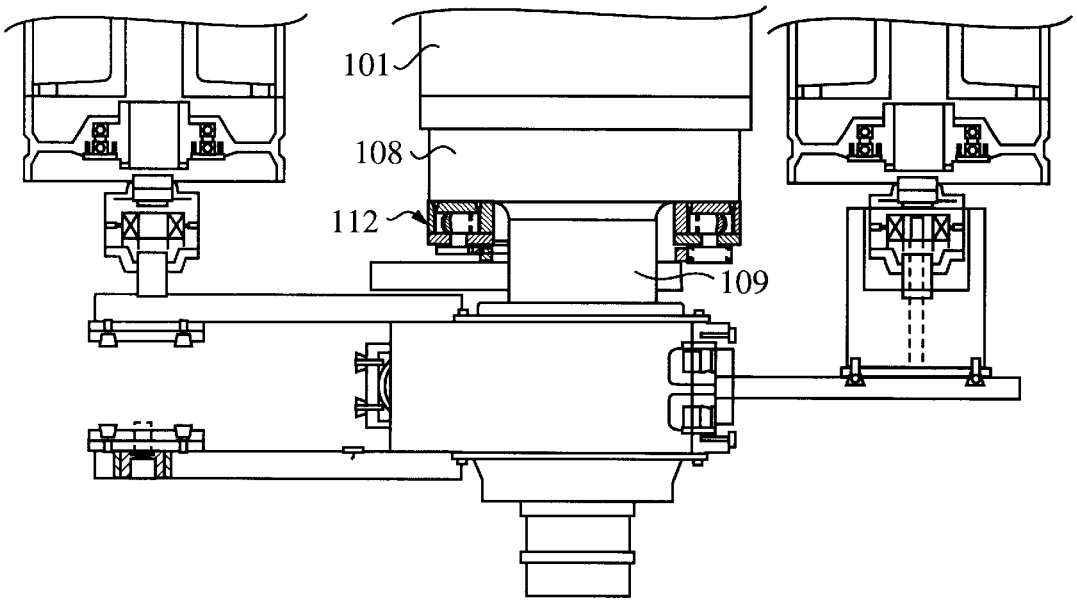
FIG. 10 illustrates a top view of an end of the roll depicted in FIG. 9.
Figure 11:
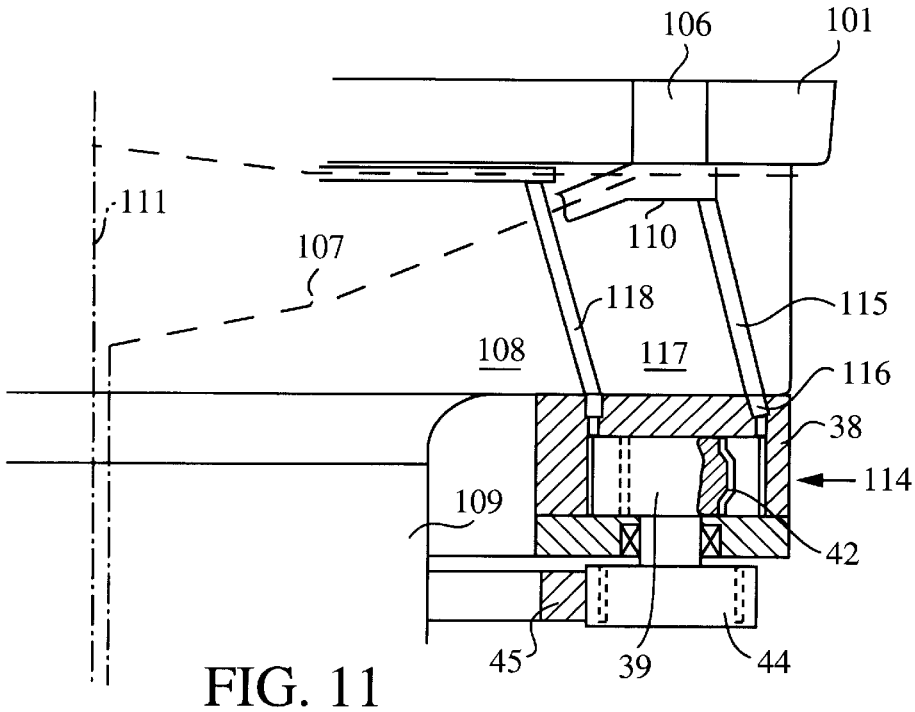
FIG. 11 illustrates a schematic diagram of a rotary pump connected to a roll.

FIG. 8 illustrates a modified embodiment of a pump 14'. The above-identified elements that are the same as those utilized in this modified embodiment are identified with identical index numbers. Corresponding (but not identical) parts have been identified with a same reference numeral and a prime notation. In FIG. 8, piston 19' is not provided with a steering edge, but rather inlet 16 may be provided with a flap valve 37. In this manner, pump 14' can operate with its own suction. Otherwise, the function of pump 14' is substantially the same as pump 14 depicted in FIGS. 5–7.

The drainage may be completely independent of the steam pressure present in channels 6 and of the temperature. In principle, drainage is dependent only on the RPM of the roll, such that the higher the RPM, the greater the drainage capacity. This is a desired effect because larger amounts of material web may be handled under high RPMs and a correspondingly larger conduction of heat may be required, which in turn causes condensate to increase.

Because support 13 may be securely flange mounted on roll pin 8 and roll pin 8 may be securely mounted on roll 1, no moving parts are necessary that would have to be sealed. Moreover, the connection between pump 14 and channels 6 may be rigidly structured, which may substantially guarantee greater dependability.

FIGS. 9–13 illustrate an alternative roll arrangement to those depicted in FIGS. 1–4. In FIGS. 9–13, elements are marked with an numeral that corresponds to the numeral designation in FIGS. 1–4 increased by 100.

Pump arrangement 112 may include a plurality of individual pumps 114 that may be evenly distributed along the circumference and arranged around roll pin 108 on the front of roll 101.

Figure 12:
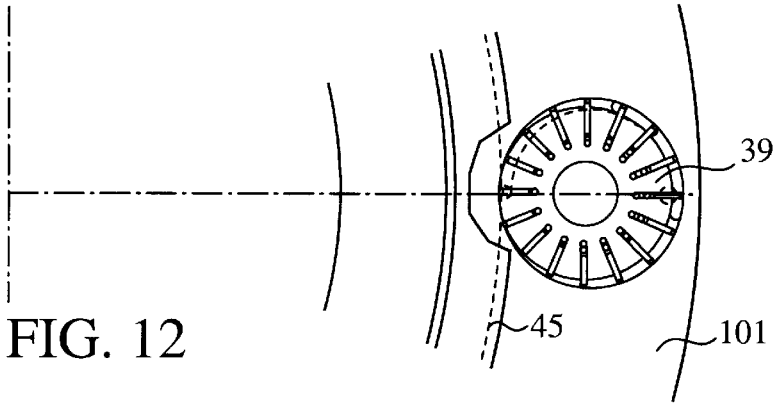
FIG. 12 illustrates a side view of the pump depicted in FIG. 11.
Figure 13:
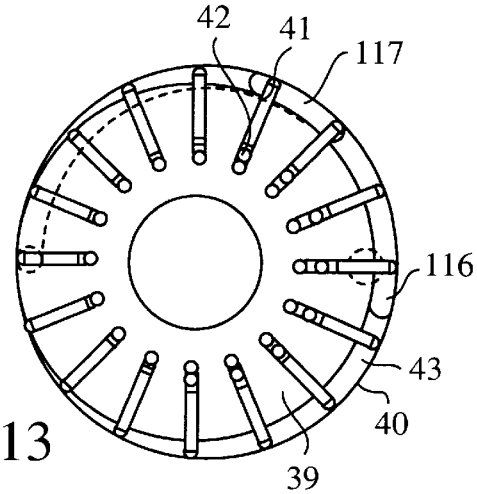
FIG. 13 illustrates an enlarged cross-section of the view depicted in FIG. 12.

Each pump 114 may include an impeller wheel 39 mounted in a housing 38, such that impeller wheel 39 may be eccentrically arranged relative to housing 38, as illustrated in FIGS. 12 and 13. Correspondingly, a pump chamber 40 may be arranged between impeller wheel 39 and housing 38, and blades 41 may be radially movable inwardly to and outwardly of pump chamber 40 and relative to impeller wheel 39. Blades 41 may be biased radially outwardly by a spring 43 (or another type of pressure device) so that they move along the inner contour of the housing 38.

Between individual blades 42, blade cells 43 may be correspondingly formed, which can be described as working chambers. On the side, condensate supply conduit 115 may empty into inlet 116 and discharge pipe 118 may originate from outlet 117. This arrangement works in such a way that inlet 116 and outlet 117 may always be separated by at least one blade 41 so that no steam can flow freely through pump 114, even when no controlling valves are in place.

Further, it should be apparent that each working chamber 43 may have a constant volume on its way from inlet 116 to outlet 117. Therefore, no compression of the condensate occurs, which minimizes the danger of damage to pump 114. Because the condensate may be forwarded to inlet 116 by centrifugal force and may be kept there under a certain pressure, working chambers 43 may fill themselves. Therefore, the condensate is only "pushed further." In any case, the necessary pressure can be built up in order to move the condensate radially inwardly to run-off pipe 111.

Pump 114 may be driven via a driving wheel 44, which may be non-rotationally coupled to impeller wheel 39. Driving wheel 44 may have an outer toothing which interlocks with a corresponding outer toothing of an opposing wheel 45. In a particular embodiment, opposing wheel 45 can be coupled in a stationary manner with bearing housing of roll 101. When roll 101 rotates, driving wheel 44 may transfer its rotational force to opposing wheel 45 and, thereby, turn impeller wheel 39.

Opposing wheel 45 can also be mounted so that it is loose or rotatable, with the same rotational axis as roll 101. In this case, it may be possible with an appropriate driving mechanism to accelerate or decelerate opposing wheel 45 and, therefore, to control the RPM of impeller wheel 39 so as to determine the amount of condensate to be transported.

In another embodiment ofthe invention, which is not depicted in further detail, it may also be possible to allow impeller wheel 39 to be driven by the steam itself In this regard, the steam can either be guided over a turbine wheel, which may be non-rotationally coupled to impeller wheel 39 or, if necessary, also over a step-up gear. The steam can also work directly on blades 41 to turn the impeller wheel 39.

Instead of the blade unit pump shown, other rotary pumps can be utilized, e.g., gear wheel pumps or centrifugal pumps. In these types of pumps, the mass distribution during rotation of roll 101 does not change, so that a relatively quiet operation can be achieved. Finally, it may also be possible not only to rotate the working element of this kind of pump, but also to make the working element orbit. However, in this embodiment, less mass displacement occurs, which can be taken into account.

The drainage may be completely independent of the steam pressure present in channels 106 and of the temperature. In principle, drainage is dependent only on the RPM of the roll, such that the higher the RPM, the greater the drainage capacity. This is a desired effect because larger amounts of material web may be handled under high RPMs and a correspondingly larger conduction of heat may be required, which in turn causes condensate to increase.

Because pump 114 may be securely flange-mounted on roll pin 108 and roll pin 108 may be securely mounted on roll 101, no moving parts are necessary that would have to be sealed. Moreover, the coupling between pump 114 and channels 106 may be rigidly structured, which may substantially guarantee greater dependability.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A steam-heated roll apparatus comprising:

a roll;

a heating chamber arrangement within the roll;

a feeding connection arrangement coupled to the heating chamber arrangement and adapted for charging the heating chamber arrangement with steam; and a pump arrangement located within the roll for pumping steam condensate out of the roll.

2. A steam-heated roll apparatus comprising:

a roll;

a heating chamber arrangement within the roll;

a feeding connection arrangement coupled to the heating chamber arrangement and adapted for charging the heating chamber arrangement with steam; and a pump arrangement, for pumping steam condensate out of the roll, being immovably coupled to the roll.

3. A steam-heated roll apparatus comprising:

a roll comprising a front and rear face;

a heating chamber arrangement within the roll;

a feeding connection arrangement coupled to the heating chamber arrangement and adapted for charging the heating chamber arrangement with steam; a pump arrangement, for pumping steam condensate out of the roll; and the pump arrangement being coupled on the front face of the roll.

4. The apparatus in accordance with claim 1, the pump arrangement comprising at least one pump with an externally operable driving element.

5. The apparatus in accordance with claim 4, further comprising a stationary driving arrangement;

the driving element being coupled to the stationary driving arrangement.

6. The apparatus in accordance with claim 5, the pump arrangement further comprising a rotating circumferential surface and a driving arrangement that acts on the pump arrangement from outside.

7. The apparatus in accordance with claim 6, the driving arrangement comprising a driving surface having a variable distance to the pump arrangement in a circumference direction.

8. The apparatus in accordance with claim 7, the driving surface being movable at substantially a same rotational speed as the pump arrangement.

9. The apparatus in accordance with claim 8, the driving surface comprising a circumferential surface of a wheel.

10. The apparatus in accordance with claim 8, the wheel being drivable and being coupled to the roll by the pump arrangement so as to provide a transfer of rotational momentum.

11. The apparatus in accordance with claim 8, further comprising:

a deflection roll positioned outside of the pump arrangement; and the driving surface comprising a driving belt that surrounds a circumferential portion of the pump arrangement and that is guided over the deflection roll.

12. The apparatus in accordance with claim 4, the driving element comprising a restoring device.

13. The apparatus in accordance with claim 1, the pump arrangement is composed of a reciprocating pump.

14. The apparatus in accordance with claim 7, the reciprocating pump comprising a piston that includes at least one of an inlet steering edge and an outlet steering edge.

15. The apparatus in accordance with claim 1, the pump arrangement comprising at least one rotary pump.

16. The apparatus in accordance with claim 15, the rotary pump comprising an externally operable working element.

17. The apparatus in accordance with claim 16, further comprising:

a pump inlet;

a pump outlet;

the pump inlet and the pump outlet being constantly separated by the working element.

18. The apparatus in accordance with claim 17, the working element extending through at least one working area during each rotation of the roll, whereby the working element moves a working chamber with constant volume from the pump inlet to the pump outlet in the at least one working area.

19. The apparatus in accordance with claim 15, the rotary pump being composed of one of a blade unit pump and a centrifugal pump.

20. The apparatus in accordance with claim 15, further comprising a stationary driving arrangement;

the working element being coupled to the stationary driving arrangement.

21. The apparatus in accordance with claim 20, further comprising a driving wheel;

the working element being coupled to the driving wheel to provide a transfer of rotational momentum.

22. The apparatus in accordance with claim 21, the driving wheel comprising one of a geared and frictional contact surface; and further comprising an opposing wheel being coupled to the driving wheel, the opposing wheel having an axis substantially parallel to a rotational axis of the roll.

23. The apparatus in accordance with claim 21, the opposing wheel being non-rotatably coupled a bearing housing of the roll.

24. The apparatus in accordance with claim 21, the opposing wheel being rotatably coupled to a bearing housing and comprising a driving mechanism.

25. The apparatus in accordance with claim 15, the working element comprising a steam driving mechanism.

26. The apparatus in accordance with claim 25, further comprising a turbine wheel that is acted upon with a flow of hot steam;

the working element being coupled to the turbine wheel so as to provide a transfer of rotational momentum to the turbine wheel.

27. The apparatus in accordance with any one of claim 1, the heating chamber arrangement comprising a plurality of periphery channels.

28. The apparatus in accordance with claim 1, further comprising at least one condensate supply conduit;

the pump arrangement being coupled to a radial outer wall of the heating chamber arrangement by the at least one condensate supply conduit.

29. The apparatus in accordance with claim 28, the heating chamber arrangement comprising a plurality of periphery channels;

each periphery channel comprising a front-side feeding chamber; and the at least one condensate supply conduit branches off from the feeding chamber.

30. The apparatus in accordance with claim 29, wherein multiple peripheral channels are associated with the feeding chamber.

31. The apparatus in accordance with claim 29, the feeding chamber being composed of a ring chamber that couples all of the peripheral channels to one another.

32. The apparatus in accordance with claim 28, the at least one condensate supply conduit being arranged to rise radially outwardly toward the pump.

33. A steam-heated roll apparatus, comprising:

a roll;

a heating chamber arrangement within the roll;

a feeding connection arrangement coupled to the heating chamber arrangement and adapted for charging the heating chamber arrangement with steam; a pump arrangement, for pumping steam condensate out of the roll;

a discharge pipe;

a back run safety device vent;

the roll including a roll peg;

a conduction segment coupled to the roll through the roll peg; and the pump coupling the discharge pipe to the conduction segment through the back run safety device vent.

* * * * *